US005845700A

United States Patent [19]

Karlsson et al.

[11] Patent Number: 5,845,700

[45] **Date of Patent: *Dec. 8, 1998**

[54] ROTARY REGENERATIVE HEAT EXCHANGER

[75] Inventors: Kurt Karlsson, Tyresö ; Dag Westerlund, Järfälla, both of Sweden

[73] Assignee: Ljungstrom Technology AB, Stockholm, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 742,951

[22] Filed: Oct. 31, 1996

[51] Int. Cl.[6] ..... F23L 15/02

[52] U.S. Cl. ..... 165/9; 165/8

[58] Field of Search ..... 165/6, 8, 9, 10

[56] References Cited

U.S. PATENT DOCUMENTS

| | | | |
|---|---|---|---|
| 3,010,704 | 11/1961 | Egbert | 165/9 |
| 3,189,084 | 6/1965 | Horn | 165/9 |
| 3,232,335 | 2/1966 | Kalbfleisch | 165/9 |
| 3,270,803 | 9/1966 | Hazzard | 165/9 |
| 4,024,907 | 5/1977 | Brzytwa | 165/9 |
| 4,159,033 | 6/1979 | Finnemore | 165/9 X |
| 4,206,803 | 6/1980 | Finnemore et al. | 165/9 |
| 4,284,125 | 8/1981 | Stockman | 165/9 |
| 4,509,583 | 4/1985 | Raths | 165/8 X |
| 4,705,098 | 11/1987 | Gerber et al. | 165/9 X |
| 4,760,875 | 8/1988 | Gibson et al. | 165/9 X |

FOREIGN PATENT DOCUMENTS

| | | |
|---|---|---|
| WO 94/01730 | 1/1994 | WIPO . |
| WO 95/00809 | 1/1995 | WIPO . |
| WO 95/01541 | 1/1995 | WIPO . |

*Primary Examiner*—Ira J. Lazarus
*Assistant Examiner*—Christopher Atkinson
*Attorney, Agent, or Firm*—Frishauf, Holtz, Goodman, Langer & Chick

[57] ABSTRACT

A regenerative heat exchanger includes first and second parts. The first part is essentially cylindrical, includes a regenerative mass, and is rotatable in relation to the second part around a common center axis. The second part includes axially directed inlets and outlets for heat emitting and heat absorbing media. The inlets and outlets of the second part are mutually separated by sector shaped plates for sealing purposes positioned near to end surfaces of the first part. The sector shaped plates are pivotally connected to axially fixed center plates attached to the second part at ends of the first part, and each of the sector shaped plates includes at a radially outer end thereof a device which has at least one support member including a circular cylindrical sliding shoe for setting a clearance between respective ends of the sector shaped plates and an edge flange provided at each end of the first part. The support member is journalled axially displaceable in a socket at the respective ends of the sector shaped plates perpendicular to the sector shaped plates, and is adjustable by means of a screw mechanism attached to the respective ends of the sector plates. The support member and the socket are provided with a guiding mechanism for preventing turning of the sliding shoe in the socket.

8 Claims, 3 Drawing Sheets

ROTARY REGENERATIVE HEAT EXCHANGER

BACKGROUND OF THE INVENTION

The present invention relates to a regenerative heat exchanger.

A heat exchanger of this kind is known from for instance SE 9302148-3, which discloses support means in the shape of sliding shoes made of carbon or graphite. This is a material that will not be rapidly destroyed by the corrosive atmosphere that is prevailing where the sliding shoes are positioned and that can resist the high temperatures which are generated. Moreover the material has excellent lubrication properties and deposits a friction reducing layer of carbon or graphite on the flanges against which the sliding shoes are slid. This results, however, at the same time in an abrasion of the sliding shoes that has proved to be difficult to foresee. For that reason it has been necessary for this kind of sliding shoe to be provided with measuring devices, which measure the clearance between the sector plates and the flanges and enable in time, i.e. before the sector plates start scraping against the flanges, a screwing forward of the support means or sliding shoes a predetermined distance so that the intended clearance is restored.

The above described measuring and adjusting operation is time consuming, and therefore it is important to reduce this work as much as possible. Such a measure consists in a reduction of the contact pressure such that the abrasion is reduced. In order to bring the sliding shoes and accordingly the sector plates to follow the flanges at the thermal deformations of the cylindrical part a contact pressure of about 500 N is required at the sliding shoes which occasionally has proved to result in a comparatively rapid wearing down.

SUMMARY OF THE INVENTION

The object of the invention is to obtain a solution of the problem of the rapid wearing down of the support means or sliding shoes.

This has according to the invention been achieved in that the support means and its socket are provided with a guiding means preventing the support means from turning in the socket.

The invention is based on the observation that the support means during operation wear in conformity with the shape of the flanges and the irregularities present on the surface of the flanges, which occurs after a rather short time. After the initial wearing, the subsequent wearing is more moderate. When the clearance has to be restored a screwing forward of the support means is performed during turning of the support means an arbitrary angle. After starting of the operation it is scarcely likely that the scratches made by abrasion in the contact surfaces of the support means by the respective flanges shall get into exactly the same angular position as before. Accordingly, new scratches will be made by abrasion forming an angle with the former scratches at each adjustment, which will result in an even more rapid wearing down at each adjustment than is the case after a change of sliding shoes.

Because the support means itself has bad wearing qualities the support means is, according to a preferred embodiment of the invention, unrotatably attached to a carrier movably journalled in the socket, which carrier is prevented from turning in the socket by guiding means.

The guiding means acting between the socket on the one hand and the carrier and/or the support means on the other hand preferably comprises a groove in a first part of the heat exchanger in which a pin protrudes attached to a second part of the heat exchanger.

BRIEF DESCRIPTION OF THE DRAWINGS

The invention will be further explained through the following schematic description of an example of an embodiment of a heat exchanger according to the invention with reference to the accompanying drawings, of which

DETAILED DESCRIPTION

Figure 1A:
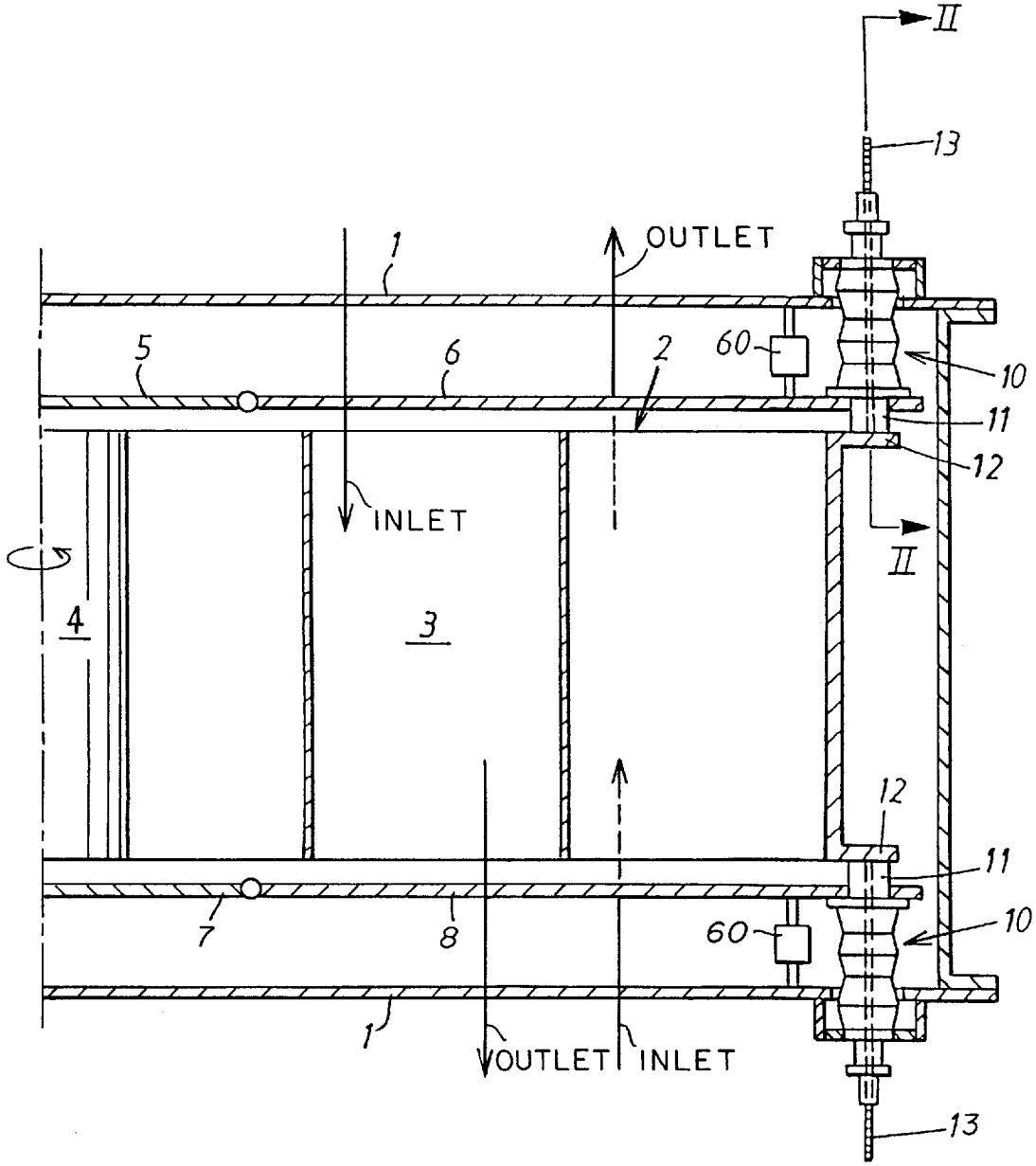
FIGS. 1*a* and 1*b* are partial sections through the heat exchanger.

The heat exchanger shown in FIG. 1*a* is of conventional type having a stationary casing 1 and a cylindrical rotor 2 containing the regenerative mass 3. The rotor has a hub 4 and an upper fixed sector plate 5 with a movable sector plate 6 pivotally connected thereto and a corresponding lower fixed center plate 7 and a movable sector plate 8. The two sets of plates 5,6 and 7,8 have the function to seal against the upper and lower ends of the rotor 2 as tight as possible and thereby separate the heat exchanging media flowing through the rotor as indicated by the arrows marked INLET arid OUTLET, respectively.

Figure 1B:
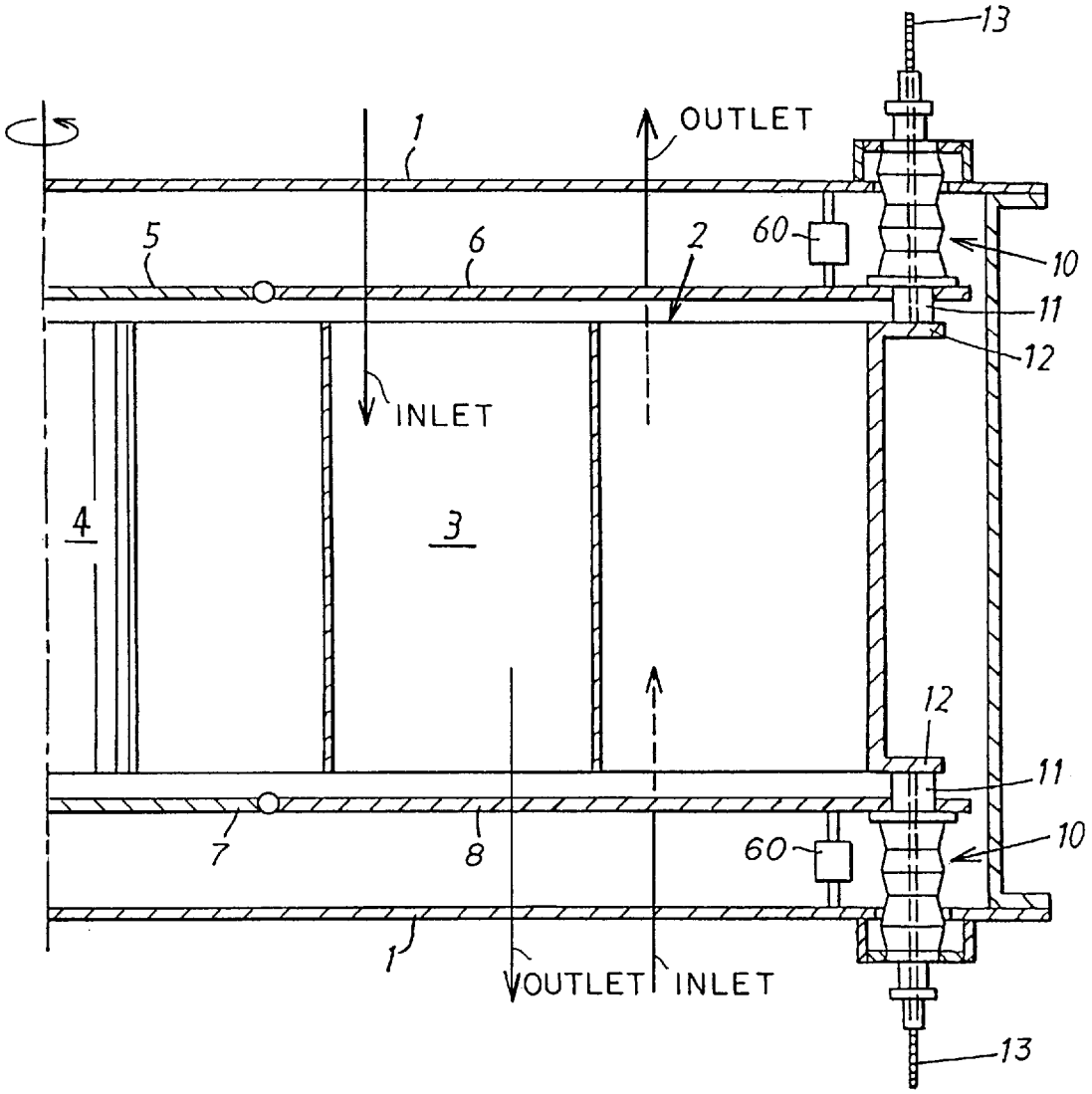

For that purpose the radially outer ends of each of the movable sector plates 6,8 are provided with at least one device, preferably two devices 10, which forms an adjustable support means 11 for maintaining a certain clearance between the ends of the sector plates 6,8 and an upper and a lower annular edge flange 12 attached to the rotor 2 along its upper and lower peripheries. Each device further comprises a measuring device 13 for checking the clearance as shown more in detail in FIG. 2 and the said SE 9302148-3. As an alternative the sector plates 5,6 and 7,8 may be rotatable in a manner known per se, and the regenerative mass stationary, as shown in FIG. 1*b*.

Figure 2:
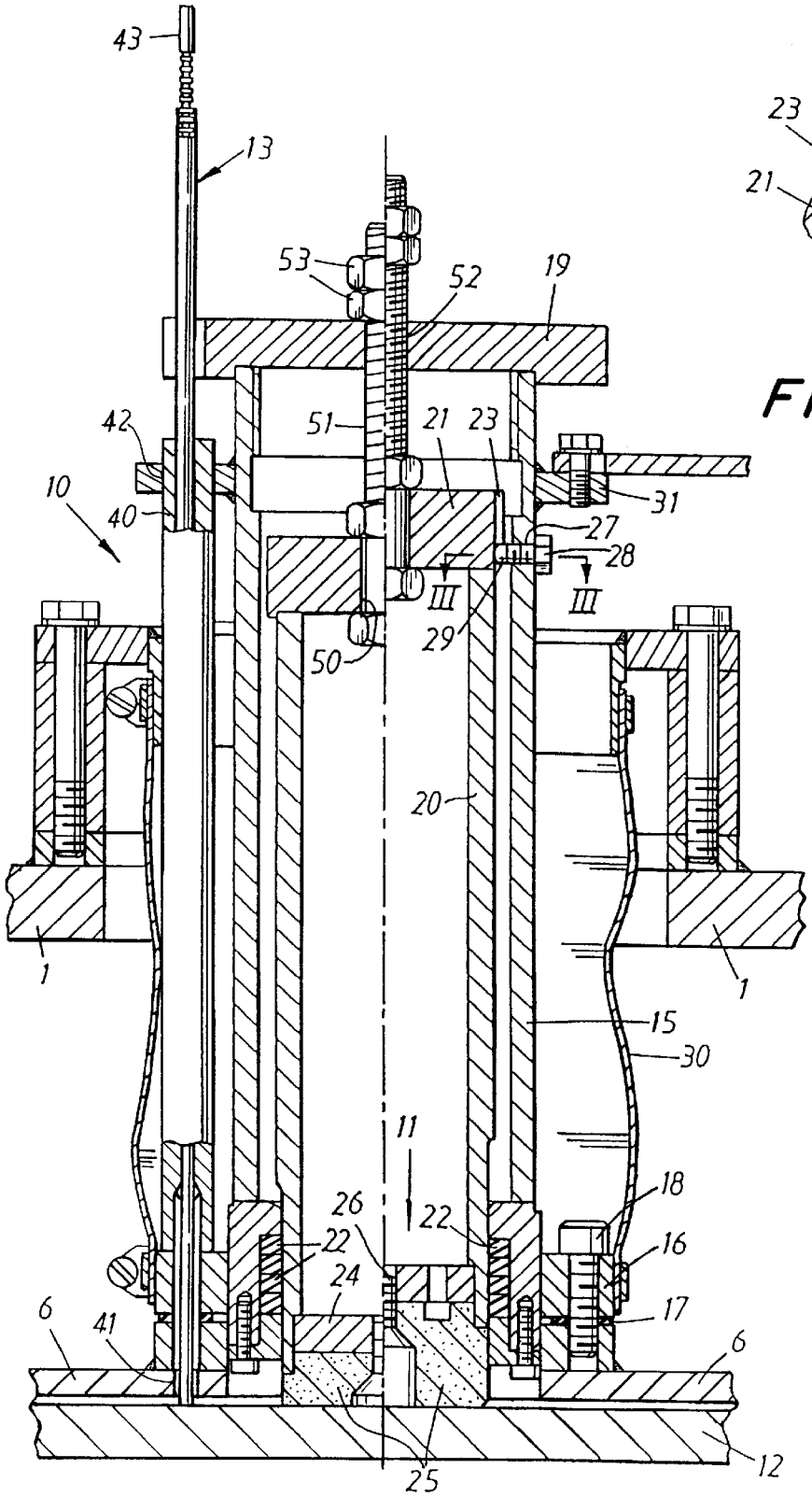
FIG. 2 is an axial section through a device with a sliding shoe at the end of a sector plate along line II—II of FIG. 1.
Figure 3:
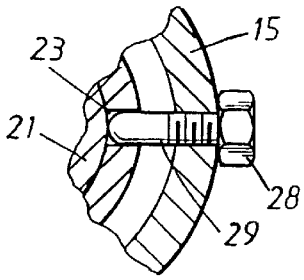
FIG. 3 is a section along line III—III of FIG. 2 of a detail illustrating the guiding means of the carrier.

FIG. 2 illustrates a part of the casing 1 and the upper end flange 12 of the rotor 2 and the upper movable sector plate 6. In a hole in the sector plate 6, one of the devices 10 is fixed by screws. The device 10 includes an outer sleeve 15 with a mounting flange 16, which with an intermediate sealing ring 17 is attached to the sector plate 6 by means of screws 18.

At its upper end the outer sleeve 15 has a lid 19 and within the outer sleeve 15 there is an inner sleeve 20 having an upper part provided with a fixedly attached lid 21. At its lower end the outer sleeve 15 is provided with a packing 22, which sealingly contacts the exterior of the inner sleeve 20. The lid 21 on the upper end of the inner sleeve 20 is provided with an axial exterior groove 23 and its lower end is provided with a bottom plate 24 welded thereto. On the underside of the bottom plate 24 a circular sliding shoe 25 made of graphite or carbon is exchangeably attached by means of a recessed screw 26 screwed into the bottom plate 24.

The upper end of the outer sleeve 15 is provided with a radial threaded hole 27 into which a screw 28 is screwed which has a pin 29 protruding into the groove 23 thereby preventing turning of the inner sleeve 20 and the sliding shoe 25 in the outer sleeve 15 acting as a socket for the inner sleeve and sliding shoe.

In parallel with the device 10 a measuring device 13 is provided close at the side thereof within a flexible bellows 30 extending between the casing 1 and the sector plate 6. It comprises a tube 40 attached with its lower end in a hole 41 in the sector plate 6 and with its upper end in a hole 42 of a flange 31 attached to the outer sleeve 15. Inside the tube 40 there is a measuring rod 43, the upper end of which operates together with a measuring member, not shown, for indicating the actual clearance between the underside of the sector plate and upper surface of the edge flange 12. The purpose of the measuring device 13 is a continuous supervision of the wearing of the sliding shoe 25 at the movement of the flange 12 with respect to the sliding shoe.

For obtaining an adjustment of the clearance the inner sleeve 20 together with the sliding shoe 25 are axially movable in the outer sleeve 15 with the pin 29 in the groove 23 permitting the movement of the inner sleeve 20 and the sliding shoe without turning. The displacement can be obtained in many ways. A simple and efficient device for this purpose comprises a hole 50 in the lid 21 in which a rod 51 is rotatably journalled and with a fine-pitch part extends through a fine-pitch hole 52 in the lid 19.

The sliding shoe 25 will be displaced in relation to the sector plate 6 by turning of the rod 51. When the intended displacement is obtained the angular adjustment of the rod 51 can be locked by two locking nuts 53, which are tightened mutually and against the lid 19. The adjustment of the rod 51 can, as an alternative, be obtained by a self-looking gear, which displaces a rod with a smooth surface, fixedly connected to the lid 21, and extending through a hole in the lid 19.

Initially a clearance of for example 4 mm is adjusted between the sector plate 6 and the edge flange 12 by turning the rod 51 by means of a key, not shown, attached to the rod, which clearance can be read off by depressing the measuring rod 43 against the edge flange 12 and reading e.g. scale marks at the upper end of the rod. When the correct clearance is obtained the inner sleeve 20 is locked in relation to the outer sleeve 15 by tightening the locking nuts 53. The measuring rod 43 is arranged to spring back again to an initial position with the lower end surface flush with the underside of the sector plate 6 when depression of the rod ceases.

The sliding shoe 25 is exposed to wearing during operation and the sector plate 6 slowly sinks towards the edge flange 12 to a corresponding degree. The actual clearance after some time of operation is checked by a slight depression of the rod 43 and reading of the magnitude of the depression. In a new heat exchanger the abrasion is rapid and the inner sleeve 20 must be screwed up and the sliding shoe must be replaced. After that the inner sleeve is screwed in position again and a correct clearance is set. Then the abrasion will be essentially slower due to a layer of carbon or graphite which is deposited on the edge flange 12 by the first sliding shoe, which deposition is lubricating.

The right hand half of FIG. 2 illustrates the device 10 provided with a fresh sliding shoe 25, and the left hand half illustrates a consumed sliding shoe 25. By using a suitable carbon/graphite quality the sliding shoe 25 can have an essentially larger height—essentially up to the lid 21—if the guiding means 23,27–29 is adapted correspondingly.

We claim:

1. A regenerative heat exchanger comprising first and second parts, wherein:

said first part is essentially cylindrical, includes a regenerative mass, and is rotatable in relation to said second part around a common center axis;

said second part includes axially directed inlets and outlets for heat emitting and heat absorbing media;

said inlets and outlets of said second part are mutually separated by sector shaped plates for sealing purposes positioned near to end surfaces of said first part;

said sector shaped plates are pivotally corrected to axially fixed center plates attached to said second part at ends of said first part, and each of said sector shaped plates includes at a radially outer end thereof a device which comprises at least one support member including a circular cylindrical sliding shoe for setting a clearance between respective ends of said sector shaped plates and an edge flange provided at each end of said first part;

said support member is journalled axially displaceable in a socket at the respective ends of said sector shaped plates perpendicular to the sector shaped plates, and is adjustable by means of a screw mechanism attached to the respective ends of said sector plates; and said support member and said socket are provided with a guiding mechanism for preventing turning of the sliding shoe in the socket during axial displacement of the support member.

2. The heat exchanger according to claim 1, wherein the support member is non-rotatably attached to a sleeve movably journalled in the socket, and the sleeve is prevented from turning in the socket by the guiding mechanism.

3. The heat exchanger according to claim 2, wherein the guiding mechanism acting between the socket and the sleeve and/or the support member comprises a groove in the sleeve, and wherein a pin attached to the socket protrudes from the groove.

4. The heat exchanger according to claim 1, wherein said screw mechanism comprises:

a rod member secured to said socket and which passes through a hole in said support member; and a locking mechanism contacting said support member for adjustment and locking of said rod member.

5. A regenerative heat exchanger comprising first and second parts, wherein:

said first part is essentially cylindrical, includes a regenerative mass;

said second part includes axially directed inlets and outlets for heat emitting and heat absorbing media;

said inlets and outlets of said second part are mutually separated by sector shaped plates for sealing purposes positioned near to end surfaces of said first part;

said sector shaped plates are rotatable in relation to said first part around a common center axis;

said sector shaped plates are pivotally connected to axially fixed center plates attached to said second part at ends of said first part, and each of said sector shaped plates includes at a radially outer end thereof a device which comprises at least one support member including a circular cylindrical sliding shoe for setting a clearance between respective ends of said sector shaped plates and an edge flange provided at each end of said first part;

said support member is journalled axially displaceable in a socket at the respective ends of said sector shaped plates perpendicular to the sector shaped plates, and is adjustable by means of a screw mechanism attached to the respective ends of said sector plates; and said support member and said socket are provided with a guiding mechanism for preventing turning of the sliding shoe in the socket during axial displacement of the support member.

6. The heat exchanger according to claim 5, wherein the support member is non-rotatably attached to a sleeve movably journalled in the socket, and the sleeve is prevented from turning in the socket by the guiding mechanism.

7. The heat exchanger according to claim 6, wherein the guiding mechanism acting between the socket and the sleeve and/or the support member comprises a groove in the sleeve, and wherein a pin attached to the socket protrudes from the groove.

8. The heat exchanger according to claim 5, wherein said screw mechanism comprises:

a rod member secured to said socket and which passes through a hole in said support member; and a locking mechanism contacting said support member for adjustment and locking of said rod member.

* * * * *